US006675594B2

(12) United States Patent
Choi et al.

(10) Patent No.: US 6,675,594 B2
(45) Date of Patent: Jan. 13, 2004

(54) COOLING SYSTEM AND COOLING METHOD

(75) Inventors: Moon-Chang Choi, Gwangmyeong (KR); Kwang-Ha Suh, Gunpo (KR); Young-Kwan Kim, Incheon (KR); Yoo-Chol Ji, Incheon (KR); Dae-Sung Wang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/179,281

(22) Filed: Jun. 26, 2002

(65) Prior Publication Data

US 2003/0094007 A1 May 22, 2003

(30) Foreign Application Priority Data

Nov. 20, 2001 (KR) ..... 2001-72408

(51) Int. Cl.[7] ..... F25B 41/00; F25B 31/00

(52) U.S. Cl. ..... 62/197; 62/505

(58) Field of Search ..... 62/114, 115, 190, 62/197, 196.4, 467, 498, 505, 508

(56) References Cited

U.S. PATENT DOCUMENTS 4,045,974 A * 9/1977 McCarty ..... 62/196
5,144,815 A * 9/1992 Ty et al. ..... 62/196.1
6,032,472 A * 3/2000 Heinrichs et al. ..... 62/199

* cited by examiner

*Primary Examiner*—Henry Bennett
*Assistant Examiner*—Malik N. Drake
(74) *Attorney, Agent, or Firm*—Fleshner & Kim, LLP

(57) ABSTRACT

A cooling system, which includes a compressor for compressing the refrigerant by operation of a motor, a condenser, an expansion means, and an evaporator, comprises a motor cooling device for cooling down the motor by making some of the refrigerant passed the condenser flow to the compressor according to temperature of the motor, and therefore the heat of high temperature generated from the motor in the compressor during the operation of the compressor which is used in the cooling system can be cooled down efficiently.

22 Claims, 6 Drawing Sheets

COOLING SYSTEM AND COOLING METHOD

BACKGROUND OF THE INVENTION

1. Field of the Invention

The present invention relates to a cooling system and a cooling method, and particularly, to a cooling system and a cooling method for cooling a motor which drives a compressor in a cooling system having a compressor for compressing refrigerant.

2. Description of the Background Art

FIG. 1 is a block diagram showing a structure of a cooling system.

Generally, a cooling system constructing a closed system comprises: a compressor 10 for compressing working fluid such as refrigerant; a condenser 20 for condensing the refrigerant compressed in the compressor 10; an expansion means 30 for lowering pressure of refrigerant condensed in the condenser 20; and an evaporator 40 for evaporating the refrigerant of liquid state which is expanded in the expansion means 30, as shown in FIG. 1.

The cooling system is applied for storing food or for maintaining indoor environment to be pleasant using warm air or cool air generated in the condenser and in the evaporator.

On the other hand, in the refrigerant system, the compressor for compressing the refrigerant is required to increase an output, or to have a large output as a size thereof is reduced according to objects of usage.

As an example, in case that a turbo compressor, which compresses the refrigerant by rotation of an impeller which is a kind of centrifugal compressors, is used in the cooling system such as an air conditioner, a relatively smaller compressor is used. In addition, in order to reduce the size of the turbo compressor, the size of the impeller should be reduced. And in order to maintain an output more than a predetermined level, the impeller should rotate at high speed relatively. Consequently, a motor for rotating the impeller should rotate at high speed.

However, when the motor rotates at high speed in order to increase output of the compressor or to reduce the size of the compressor, a lot of heat is generated from the motor. The generated heat of high temperature may damage the motor, or may damage components around a motor mounting chamber. Therefore, the motor should be cooled down in order to be operated as maintaining stable state continuously.

FIG. 2 is a cross-sectional view showing a turbo compressor which is one of compressors used in the cooling system shown in FIG. 1.

U.S. Pat. No. 6,009,722 suggests a structure for cooling a motor as a method for cooling the motor of the turbo compressor used in the cooling system.

According to U.S. Pat. No. 6,009,722, the turbo compressor comprises a motor mounting chamber C, in which the motor M is mounted, formed inside a casing 11, and a first and a second compression chambers C1 and C2 disposed on both sides of the motor mounting chamber C, as shown in FIG. 2.

In addition, the first and second compression chambers C1 and C2 are located on both sides of the motor M, and a first and a second impellers 13 and 14 are coupled to both ends of a rotational shaft 12 of the motor.

A suction pipe P1, which is connected to an evaporator 40 so that the refrigerant of low pressure has passed an evaporating process in the evaporator 40 can be flowed into the motor mounting chamber C, is coupled to the casing 11, a first connection flow path F1 for communicating the motor mounting chamber C and the first compression chamber C1 so that the refrigerant gas passed through the motor mounting chamber C can be flowed into the first compression chamber C1 is disposed, and a second connection flow path F2 for communicating the first compression chamber C1 and the second compression chamber C2 so that the refrigerant gas compressed firstly in the first compression chamber C1 can be flowed into the second compression chamber C2 is disposed.

In addition, an exhaust pipe P2 for guiding the refrigerant gas which has compressed secondly in the second compression chamber C2 to be exhausted toward the condenser 20 comprised in the cooling system is coupled to the casing 11 so as to communicate with the second compression chamber C2.

In the turbo compressor having the above structure, when the motor M is rotated by being applied electric current, the rotational force is transmitted to the first and the second impellers 13 and 14 through the rotational shaft 12 to rotate the first and second impellers 13 and 14 inside the first and second compression chambers C1 and C2 respectively. As the first and second impellers 13 and 14 rotate in the first and second compression chambers C1 and C2 respectively, the refrigerant of low temperature and low pressure state which has passed through the evaporator is flowed into the motor mounting chamber M through the suction pipe P1 by a pressure difference generated in the first and second compression chambers C1 and C2. And the refrigerant gas flowed into the motor mounting chamber C is sucked into the first compression chamber C1 through the first connection flow path F1 as passing through the motor mounting chamber C, and compressed firstly in the first compression chamber C1.

The refrigerant gas compressed firstly in the first compression chamber C1 is flowed into the second compression chamber C2 through the second connection flow path F2, and is compressed secondly in the second compression chamber C2. And the refrigerant gas of high temperature and high pressure state compressed secondly in the second compression chamber C2 is exhausted through the exhaust pipe P2, and the exhausted refrigerant gas is flowed into the condenser 20 which consists of the cooling system.

Especially, the refrigerant gas of low temperature and low pressure state which has passed through the evaporator 40 is flowed into the motor mounting chamber C through the suction pipe P1, meanwhile, the refrigerant gas cools down the motor by sucking the heat generated from the motor M.

However, the structure for cooling motor is not able to cool down sufficiently the heat generated from the motor M, and especially, the motor M may be damaged if an overloaded state is maintained. Also, the refrigerant gas sucked into the first compression chamber C1 is sucked as passing through the motor mounting chamber C, and therefore, the refrigerant gas is sucked in heated state and a specific volume of the refrigerant gas is reduced. Therefore, the compressing efficiency is also reduced.

SUMMARY OF THE INVENTION

Therefore, an object of the present invention is to provide a cooling system which is able to cool down heat of high temperature which is generated from a motor of a compressor while the compressor used in a cooling system is operated.

To achieve the object of the present invention, as embodied and broadly described herein, there is provided a cooling system including a motor cooling means which cools down the motor by making some of refrigerant passed through a condenser flow to the compressor, wherein the cooling system comprises a compressor for compressing the refrigerant by operation of the motor.

Also, there is provided a cooling system, which comprises a compressor for compressing refrigerant by an operation of a motor, a condenser, an expansion means, and an evaporator, for cooling down the motor by making some of refrigerant passed through the condenser flow to the compressor.

Also, there is provided a cooling method which measures a temperature of a motor, and cools down the motor by injecting refrigerant which has passed through the condenser when the temperature of the motor is higher than a set temperature, in a cooling system comprising a compressor for compressing refrigerant by an operation of a motor, a condenser, an expansion means, and an evaporator.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
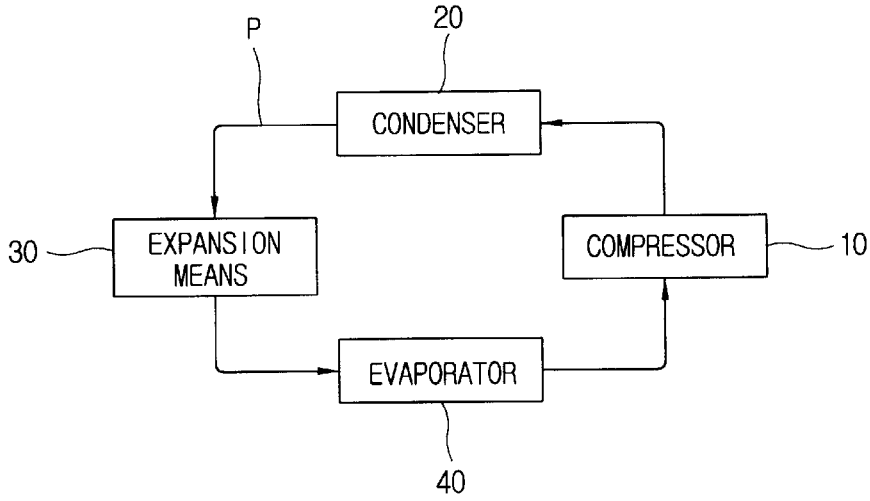
FIG. 1 CONVENTIONAL ART
FIG. 1 is a block diagram showing a structure of a cooling system.
Figure 2:
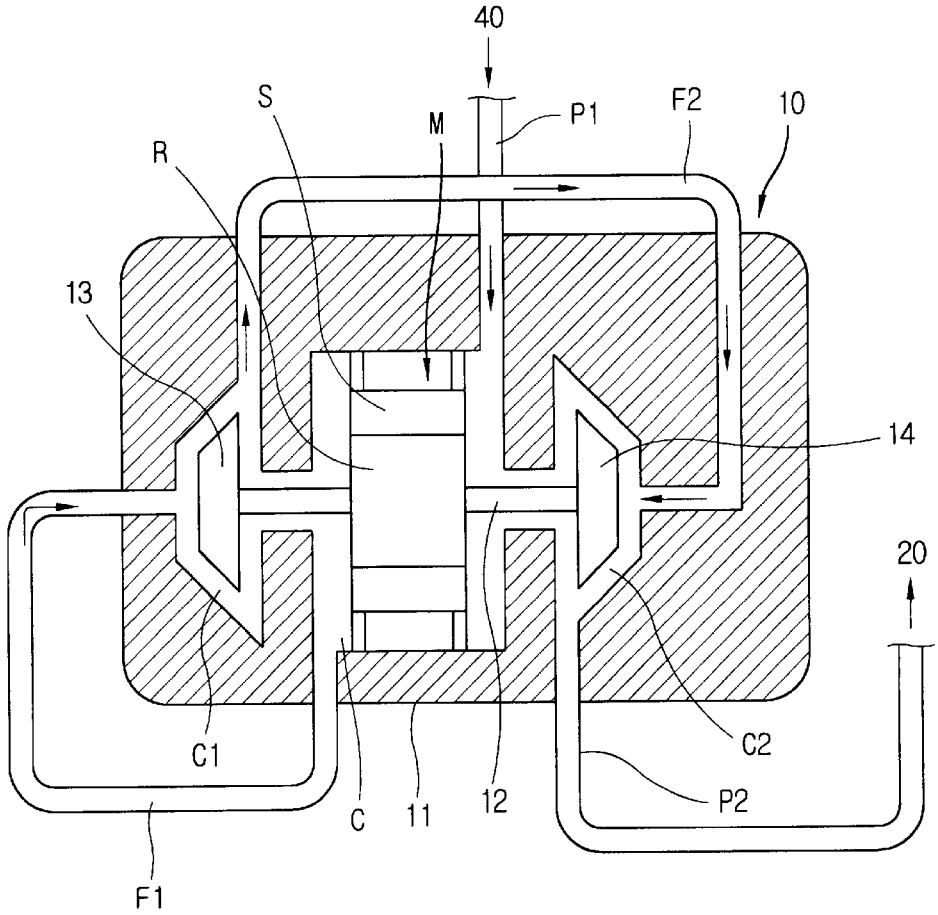
FIG. 2 CONVENTIONAL ART
FIG. 2 is a cross-sectional view showing a turbo compressor which is one of compressors used in the cooling system shown in FIG. 1.
Figure 3:
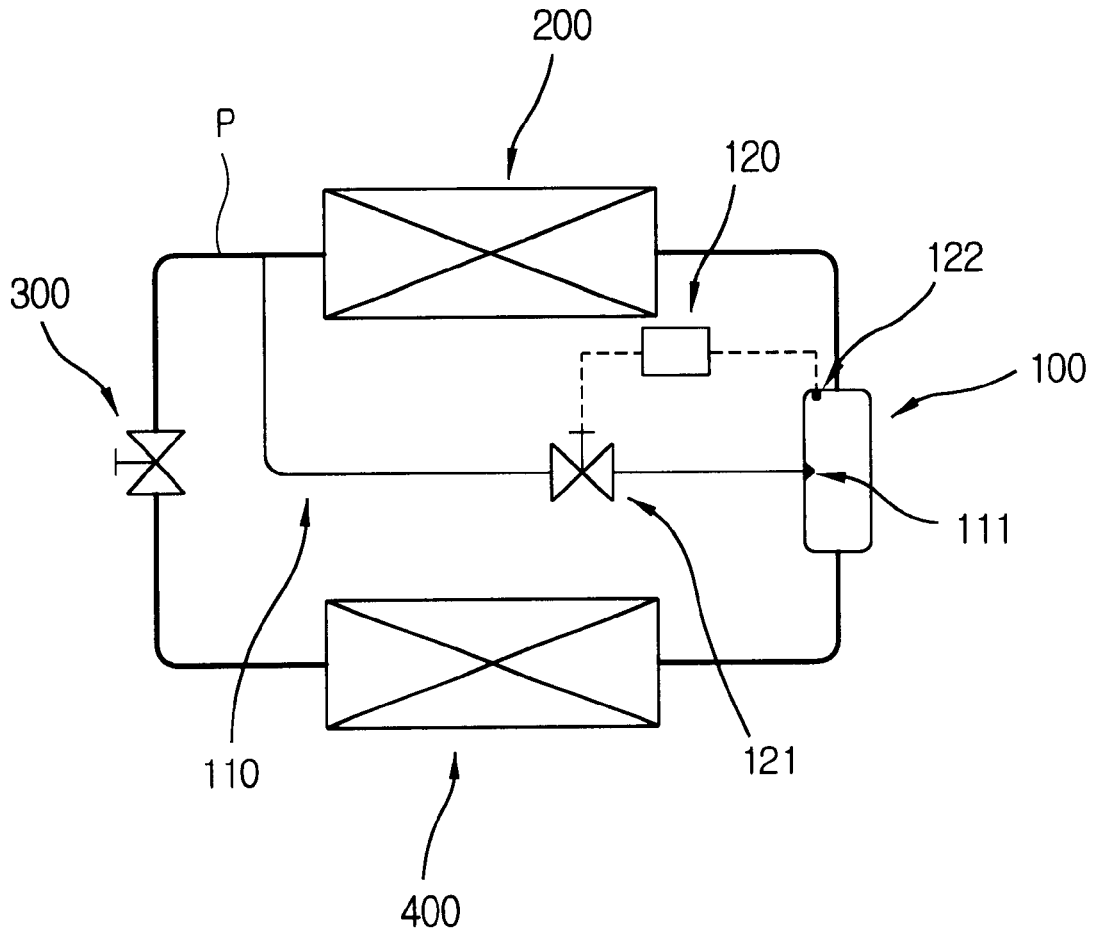
FIG. 3 is a block diagram showing a structure of a cooling system according to a first embodiment of the present invention.

FIG. 3 is a block diagram showing a structure of a cooling system according to a first embodiment of the present invention.

As shown therein, the cooling system according to the first embodiment of the present invention comprises: a compressor 100 for compressing refrigerant by an operation of a motor M, a condenser 200, an expansion means 300, and an evaporator 400, and further comprises a motor cooling means which cools down the motor M by making some of the refrigerant which has passed through the condenser 200 flow to the compressor 100.

The motor cooling means comprises a refrigerant dividing flow path 110 for making some of the refrigerant which has passed through the condenser 200 flow to the compressor 100.

Also, the motor cooling means comprises a controller 120 for controlling the refrigerant passed through the condenser 200 so that some of the refrigerant flows to the refrigerant dividing flow path 110 when the temperature of the motor M is higher than a set temperature. That is, the controller 120 controls the temperature of the motor M to be maintained lower than the set temperature, and the refrigerant to be flowed into the refrigerant dividing flow path 110.

Also, the motor cooling means includes an opening/closing valve 121 as a means for opening/closing the refrigerant dividing flow path 110 by the control of the controller 120. And the opening/closing valve 121 is installed to be connected with the refrigerant dividing flow path 110 so as to open/close the refrigerant dividing flow path 110.

Also, the motor cooling means further comprises a temperature measuring unit 122 for measuring the temperature of the motor M in order to cool down the motor M so that the temperature of the motor M is maintained lower than a temperature set earlier. And the temperature measuring unit 122 is installed on an appropriate position of the motor M in order to measure the temperature of the motor M precisely.

Also, it is desirable that the motor cooling means further comprises an injection nozzle 111 which is connected to the refrigerant dividing flow path 110 in order to inject the refrigerant passed through the condenser to the motor M.

Especially, a plurality of injection nozzles 111 may be formed in order to cool down the motor M more efficiently. And the injection nozzles 111*a* and 111*b* for cooling down a rotor or a stator comprised in the motor M may be installed.

The number and position of the injection nozzle 111 are decided by passing through a general experiment as considering of appropriate temperature required for the motor M.

Figure 4:
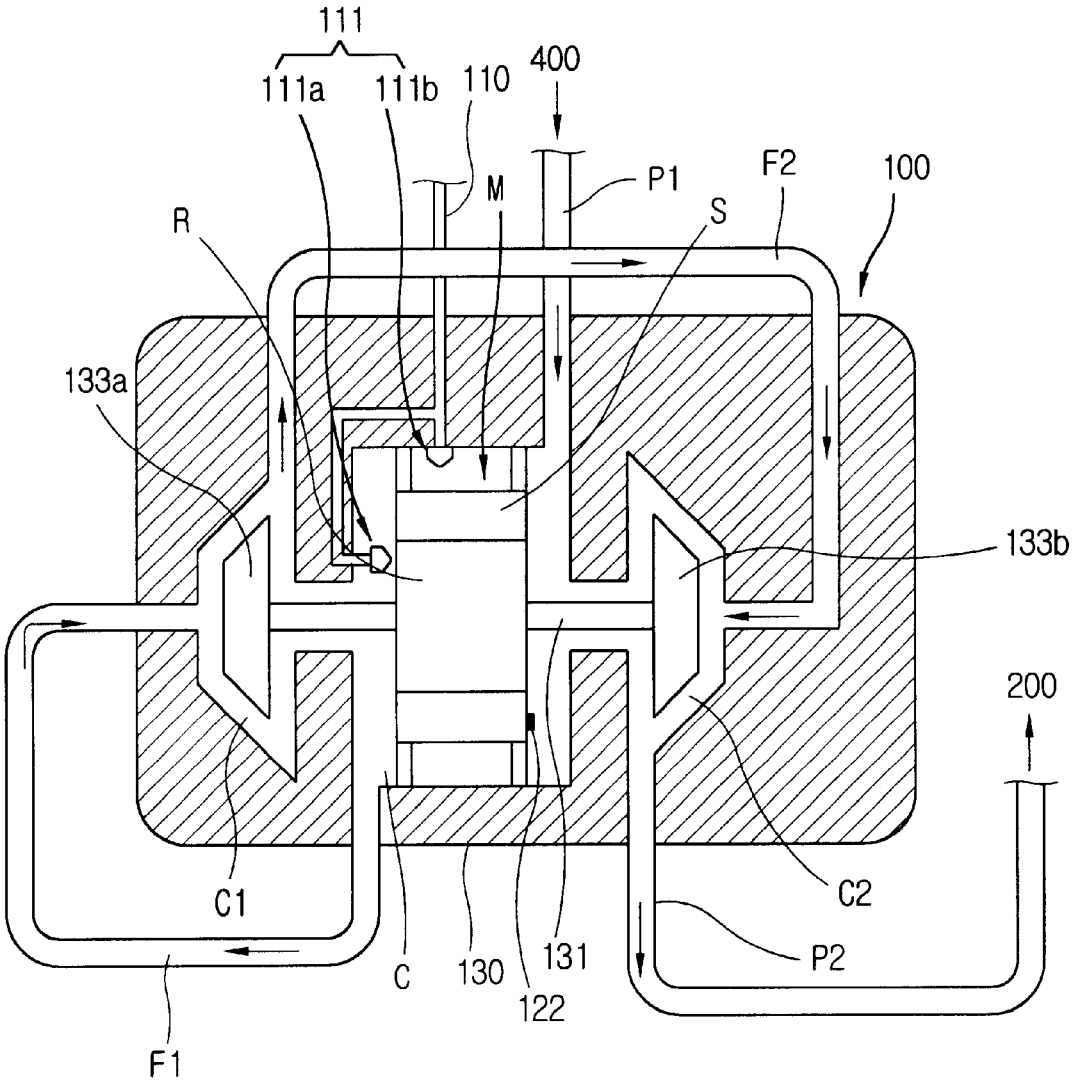
FIG. 4 is a cross-sectional view showing a compressor in case that the compressor used in the cooling system of the first embodiment is the turbo compressor.

On the other hand, a cooling system including the turbo compressor according to a first embodiment of the present invention, as shown in FIG. 4, comprises: a casing 130 including a motor mounting chamber C therein, and a first and second compression chambers C1 and C2 formed on both sides of the motor mounting chamber C; a motor M mounted in the motor mounting chamber C in the casing 130; a rotational shaft 131 coupled to the motor M, that is, to a rotor R of the motor M which comprises the rotor R and a stator S; a first and a second impellers 133*a* and 133*b* located respectively in the first and second compression chambers C1 and C2 so as to be rotatable, and coupled to both ends of the rotational shaft 131; a suction pipe P1 coupled to the casing 130 for guiding the refrigerant gas to be induced into the motor mounting chamber C of the casing 130; a first connection flow path F1 for communicating the motor mounting chamber C and the first compression chamber C1; and a second connection flow path F2 for communicating the first compression chamber C1 and the second compression chamber C2; and an exhaust pipe P2 coupled to the casing 130 for exhausting the refrigerant gas which is compressed secondly in the second compression chamber C2.

Herein, the number of the impeller 133 is not limited, and therefore, one impeller may be formed, or two or more impellers may be formed for multi compressing.

In addition, the refrigerant dividing flow path 110 is connected to a connecting pipe P which connects the condenser 200 and the expansion means 300, the injection nozzle 111 for injecting the refrigerant inside the casing 130 is disposed on the casing 130 of the turbo compressor 100, and the injection nozzle 111 is coupled to the refrigerant dividing flow path 110.

The injection nozzle 111 comprises a stator injection nozzle 111*a* for injecting condensed refrigerant to the stator S of the motor, and a rotor injection nozzle 111*b* for injecting the condensed refrigerant to the rotor R of the motor.

In addition, the opening/closing valve 121 for controlling the flow of the condensed refrigerant is coupled to the refrigerant dividing flow path 110, and the temperature measuring unit 122 for sensing the temperature of the motor M is mounted on an appropriate position of the motor M in the turbo compressor. And the controller 120 for controlling opening and closing degree of the opening/closing valve 121 according to the temperature of the motor M is disposed. A general temperature sensor, etc. can be used as the temperature measuring unit 122, and an electric valve, etc. can be used as the controller 120.

On the other hand, in order to cool down the motor, a flow path through which the refrigerant can be flowed may be formed on outer side of the motor instead of injecting the refrigerant to the motor, and therefore, the refrigerant flows the flow path to cool down the motor.

Figure 5:
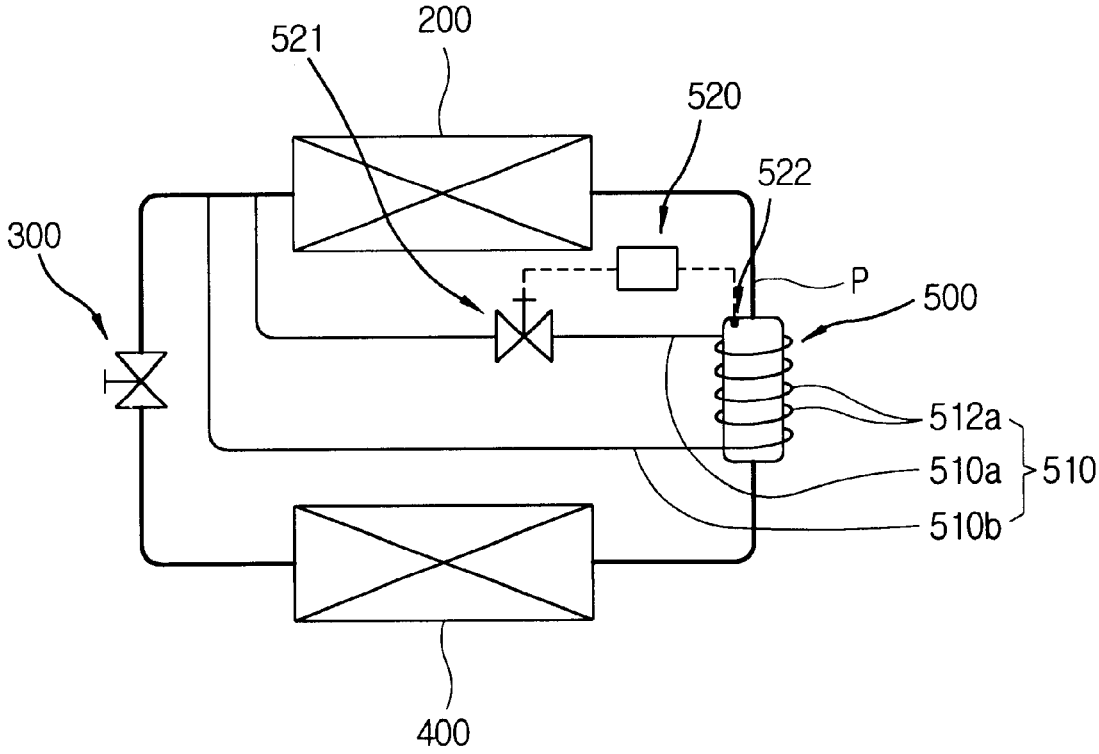
FIG. 5 is a block diagram showing a structure of a cooling system according to a second embodiment of the present invention.
Figure 6:
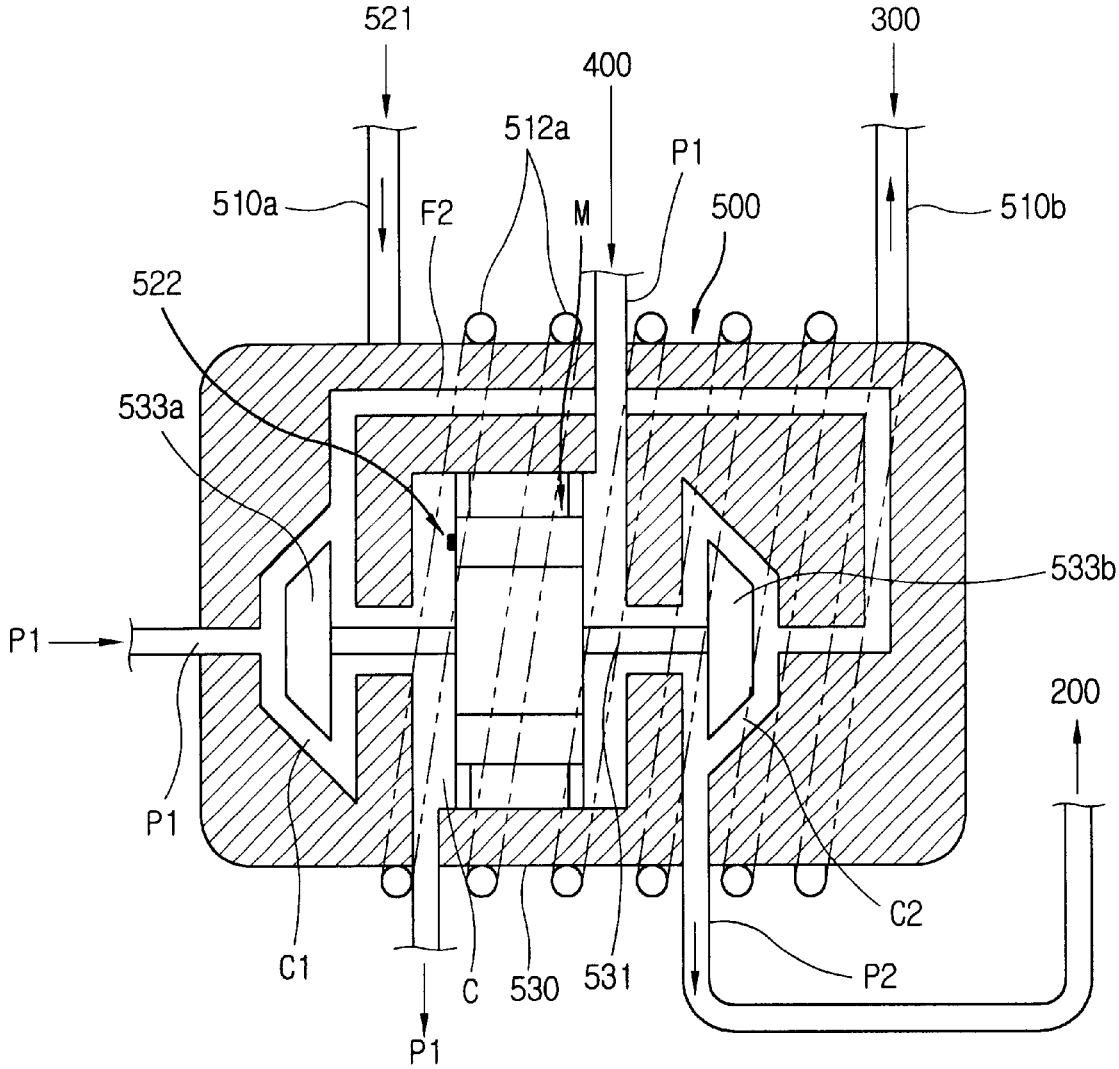
FIG. 6 is a cross-sectional view showing a compressor in case that the compressor used in the cooling system of the second embodiment is the turbo compressor.

FIG. 5 is a block diagram showing a structure of a cooling system according to the second embodiment of the present invention, and FIG. 6 is a cross-sectional view showing a compressor in case that the compressor used in the cooling system of the second embodiment is turbo compressor.

As shown in FIG. 5, the cooling system according to the second embodiment of the present invention comprises: a compressor 500 for compressing refrigerant by an operation of the motor M; a condenser 200, an expansion means 300, and an evaporator 400, and comprises a motor cooling means which cools down the motor M by making some of the refrigerant passed through the condenser 200 flow to the compressor 500.

The motor cooling means comprises a refrigerant dividing flow path 510 for making some of the refrigerant passed through the condenser 200 flow to the compressor 500, and the refrigerant dividing flow path 510 is formed so as to cover the motor M and includes a motor cooling unit 512*a* connected to the expansion means 300.

Especially, the motor cooling unit 512*a* may comprise the flow path formed in the motor mounting chamber M, the motor M may be mounted as adhering to an inner surface of the motor mounting chamber C, and the motor cooling unit 512*a* may comprise a flow path which is additionally formed on outer side of the motor M.

Also, the motor cooling means comprises a controller 520 for controlling some of the refrigerant passed through the condenser 200 to be flowed to the refrigerant dividing flow path 510 when the temperature of the motor M is higher than a set temperature.

Also, the motor cooling means comprises an opening/closing valve 521 as a means for opening and closing the refrigerant dividing flow path 510 by the control of the controller 520. And the opening/closing valve 521 is installed to be connected to the refrigerant dividing flow path.

Also, the motor cooling means further comprises a temperature measuring unit 522 for measuring the temperature of the motor M in order to control the controller 520.

In addition, as shown in FIG. 6, in a cooling system, including the turbo compressor, according to the second embodiment of the present invention, a first refrigerant dividing flow path 510*a* is connected to one side of the connecting pipe P which connects the condenser 200 and the expansion means 300, a motor cooling unit 512*a* which is wound as a coil is formed on outer surface of the casing 530 of the turbo compressor 500, and the first refrigerant dividing flow path 510*a* is coupled to one side of the motor cooling unit 512*a* so as to be connected to the motor cooling unit 512*a*.

In addition, a second refrigerant dividing flow path 510*b* for communicating the motor cooling unit 512*a* and the connecting pipe P so that the refrigerant passed through the motor cooling unit 512*a* is flowed into the expansion means 300 is disposed, and the opening/closing valve 521 controlling the flow of the condensed refrigerant is mounted on the first refrigerant dividing flow path 510*a*. The connecting pipe P, to which the second refrigerant flow path is connected, connects the condenser 200 and the expansion means 300.

In addition, the temperature measuring unit 522 for measuring the motor temperature of the turbo compressor 500 is mounted on the motor M of the turbo compressor 500, and the controller 520 for controlling the opening/closing degree of the opening/closing valve 521 according to the temperature of the motor M which is recognized by the temperature measuring unit 522 is disposed.

Figure 7:
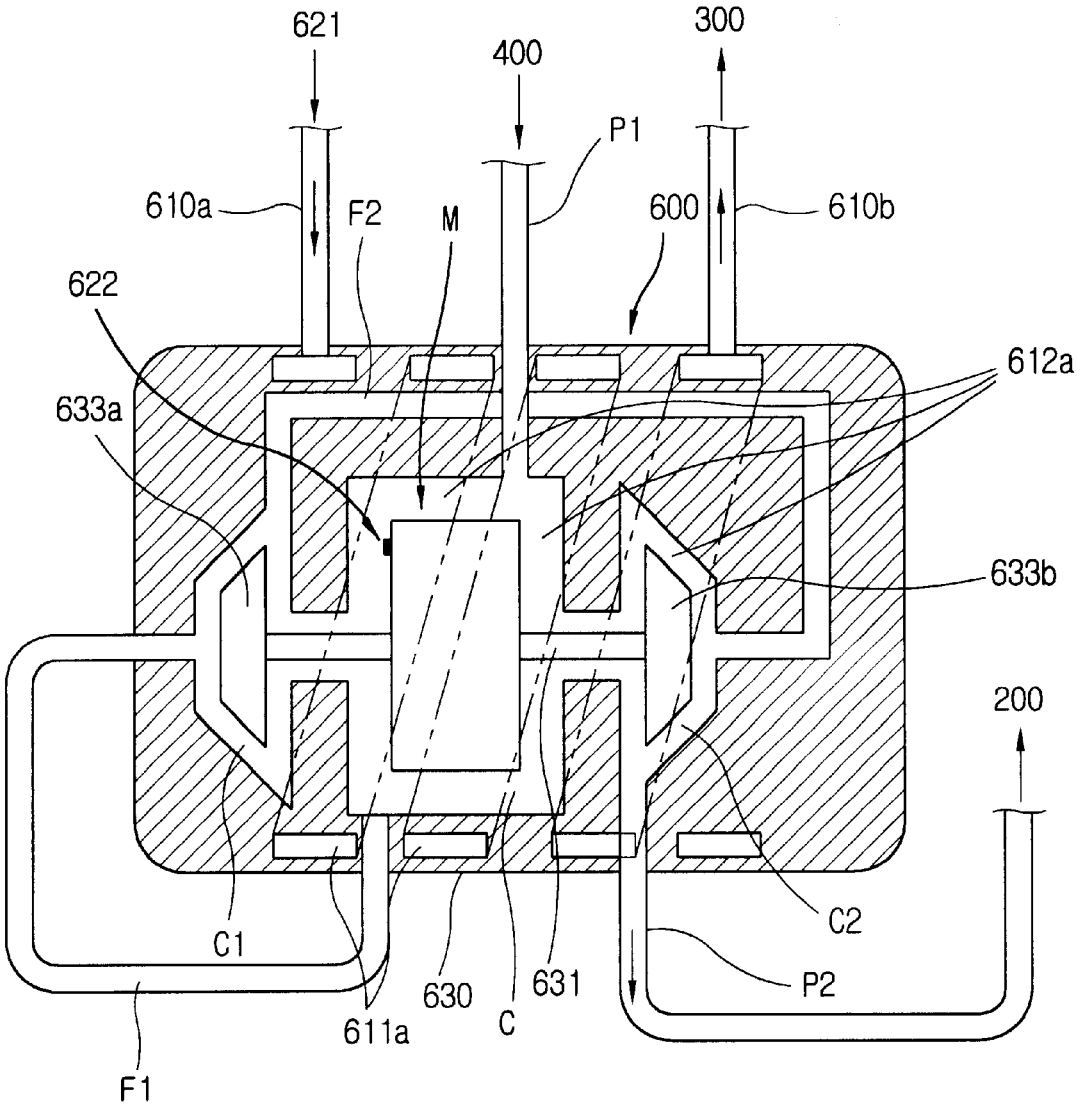
FIG. 7 is a cross-sectional view showing a compressor in case that the compressor used in the cooling system of a third embodiment is the turbo compressor.

FIG. 7 is a cross-sectional view showing a compressor in a cooling system according to a third embodiment of the present invention.

As shown in FIG. 7, in the cooling system according to the third embodiment of the present invention, a first refrigerant dividing flow path 610*a* is connected to one side of the connecting pipe P which connects the condenser 200 and the expansion means 300, a motor cooling unit 612*a* on which a cooling flow path 611*a* is formed is installed on entire inner wall of the casing 630, and the first refrigerant flow path 610*a* is coupled to the casing 630 so as to be connected to one side of the cooling flow path 611*a* of the casing 630.

In addition, a second refrigerant dividing flow path 610*b* for communicating the cooling flow path 611*a* and the connecting pipe P is coupled to the casing 630 so that the refrigerant passed through the cooling flow path 611*a* of the casing 630 is induced into the expansion means 300. In addition, an opening/closing valve 621 for controlling the flow of the condensed refrigerant is mounted on the first refrigerant dividing flow path 610*a* the connecting pipe P connects the condenser 200 and the expansion means 300.

In addition, a temperature measuring unit 622 for sensing the temperature of the motor M is mounted on the motor M of the turbo compressor, and a controller 620 for controlling opening/closing degree of the opening/closing valve 621 according to the temperature of the motor M is disclosed.

Hereinafter, operation and effect of the cooling system according to the present invention will be described in detail.

When electric power is applied to the cooling system according to the present invention, the motor M of the compressor 100 is operated to generate a rotational force. In addition, the rotational force of the motor M is transmitted to the first and second impellers 133*a* and 133*b* respectively through the rotational shaft 131, and thereby, the first and second impellers 133*a* and 133*b* are rotated in the first and second compression chambers C1 and C2 respectively.

As the first and second impellers 133*a* and 133*b* rotate respectively in the first and second compression chambers C1 and C2, the refrigerant of low temperature and low pressure state which has passed through the evaporator 400 is induced into the motor mounting chamber C through the suction pipe P1. And the refrigerant gas passed the motor mounting chamber C is induced into the first compression chamber C1 through the first connection flow path F1 to be compressed firstly in the first compression chamber C1, and then, the refrigerant is induced into the second compression chamber C2 through the second connection flow path F2 to be compressed secondly in the second compression chamber C2.

The refrigerant gas of high temperature and high pressure state which has compressed secondly in the second compression chamber C2 of the compressor 100 is exhausted to the condenser 200 through the exhaust pipe P2. And the exhausted refrigerant gas is condensed as emitting inner latent heat to outer side while passing through the condenser 200.

The refrigerant of liquid state which is condensed as passing through the condenser 200 is changed into low temperature and low pressure status as passing through the expansion means 300, and then induced into the evaporator 400. The refrigerant of liquid phase induced into the evaporator is vaporized by sucking the heat of outer side. The refrigerant gas of low temperature and low pressure status which is changed into gas phase in the evaporator 400 is sucked into the first and second compression chambers C1 and C2 through the connection pipe P and the suction pipe P1 of the turbo compressor, and then compressed.

On the other hand, when the temperature sensed by the temperature measuring unit 122 mounted on the turbo compressor 100 is higher than a set temperature during driving the cooling system, the opening/closing valve 121 is opened by the control of the controller 120. Then, some of the condensed refrigerant which is flowing to the expansion means after passing through the condenser 200 is induced through the refrigerant dividing flow path 110, and injected to the motor M which is mounted inside the casing 130 through the injection nozzle 111, that is, through the stator injection nozzle 111*a* and the rotor injection nozzle 111*b*. Thereby, the heat of high temperature generated from the motor M can be cooled down.

Therefore, the motor M generates the heat most during the operation of the turbo compressor 100. And when the heat generated from the motor M is cooled down, the overheating of the compressor 100 can be prevented.

In addition, when the condensed refrigerant is injected to the motor M and the temperature of the motor M is decreased lower than the set temperature, the opening/closing valve 121 is closed by the control of the controller 120. Then, some of the condensed refrigerant which is flowed to the expansion means 300 is not flowed to the refrigerant dividing flow path 110, but flowed to the expansion means 300. Therefore, the condensed refrigerant is not injected through the injection nozzle 111.

Also, in case of the cooling system according to the second embodiment of the present invention, when the temperature sensed by the temperature measuring unit 522 mounted on the turbo compressor 500 is higher than the set temperature, the opening/closing valve 521 is opened by the control of the controller 520. Then some of the refrigerant which flows toward the expansion means after passing through the condenser 200 is induced into the motor cooling unit 512*a* through the first refrigerant dividing flow path 510*a*, and the condensed refrigerant cools down the heat of high temperature generated from the motor M while flowing through the motor cooling unit 512*a*. In addition, the condensed refrigerant which cooled down the heat from the motor M is flowed through the second refrigerant dividing flow path 510*b* to be induced into the expansion means 300 through the connection pipe P.

In addition, when the temperature of the motor M is decreased lower than the set temperature by injecting the refrigerant to the motor M, the opening/closing valve 521 is closed by the controller 520. Then, some of the condensed refrigerant is not flowed to the first refrigerant dividing flow path 510*a*, but flowed to the expansion means 300, and thereby the condensed refrigerant is not flowed to the motor cooling unit 512*a*.

In the cooling system according to the third embodiment of the present invention, some of the condensed refrigerant passed through the condenser 200 is induced into the motor cooling unit 612*a*, which is formed on the inner wall of the casing 630, through the first refrigerant dividing flow path 620*a*, and cools down the turbo compressor 600 as flowing on the motor cooling unit 612*a*. In addition, the refrigerant passed through the motor cooling unit 612*a* of the casing 630 is induced into the expansion means 300 through the second refrigerant dividing flow path 610*b*.

According to the present invention, the turbo compressor which is operated at high speed is cooled down using the condensed refrigerant which is condensed in the condenser comprised in the cooling system, and therefore, cooling the turbo compressor can be made smoothly to prevent the motor of the turbo compressor which generates rotational force of high speed from being overheated.

As described above, according to the cooling system for the turbo compressor of the present invention, the turbo compressor can be cooled down efficiently using the liquid refrigerant which circulates in the cooling system, and therefore, the overheating of the motor and the compressing devices by the heat generated from the motor consisting of the turbo compressor can be prevented. Thereby, the motor and compressing devices of the turbo compressor can be prevented from being damaged, the life span of the compressor can be increased, and the reliability of the turbo compressor can be increased.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A cooling system, which includes a compressor for compressing the refrigerant by operation of a motor, a condenser, an expansion means, and an evaporator, comprising:

a compressor including a casing, in which a motor mounting chamber for mounting the motor is formed and a first and a second compression chambers are formed on both sides of the motor mounting chamber, and a first and a second impellers installed in the first and second compression chambers respectively;

a refrigerant flow path which is formed so that the refrigerant is exhausted to the condenser after passing through the motor mounting chamber, the first compression chamber, and the second compression chamber from the evaporator; and a motor cooling means including a refrigerant dividing flow path for making some of the refrigerant passed through the condenser flow to the compressor, a temperature measuring unit for measuring the temperature of the motor, a controller for controlling some of the refrigerant passed through the condenser to be flowed to the refrigerant dividing flow path when the temperature of the motor is higher than a set temperature, and an opening/closing means for opening/closing the refrigerant dividing flow path by the control of the controller.

2. The system of claim 1, wherein the motor cooling means further comprises an injection nozzle connected to the refrigerant dividing flow path in order to inject the refrigerant which has passed through the condenser to the motor.

3. The system of claim 1, wherein the refrigerant dividing flow path comprises a first refrigerant dividing flow path for cooling down a rotor of the motor, and a second refrigerant dividing flow path for cooling down a stator of the motor.

4. The system of claim 1, wherein the refrigerant dividing flow path is formed to cover the motor, and to be connected to the expansion means.

5. The system of claim 1, wherein the refrigerant dividing flow path is formed within the casing, and to be connected to the expansion means.

6. A cooling system, which includes a compressor with a motor, a condenser, an expansion means, and an evaporator, comprising:

a motor cooling device for cooling down the motor by directly coupling a portion of the refrigerant to go from the condenser to the compressor.

7. The system of claim 6, wherein the motor cooling device injects refrigerant directly from the condenser to the compressor.

8. The system of claim 6, wherein the motor cooling device further comprises an injection nozzle connected to a refrigerant dividing flow path in order to inject the refrigerant passed through the condenser to the motor.

9. The system of claim 8, wherein the refrigerant dividing flow path comprises a first refrigerant dividing flow path for cooling down a rotor of the motor, and a second refrigerant dividing flow path for cooling down a stator of the motor.

10. The system of claim 8, wherein the motor cooling device is formed to cover the motor, and comprises the refrigerant dividing flow path connected to the expansion means.

11. The system of claim 8, wherein the refrigerant dividing flow path is formed within a casing receiving the motor, and to be connected to the expansion means.

12. A cooling method for cooling down a motor, comprising:

measuring a temperature of a motor;

directing a portion of a refrigerant from a condenser directly to the motor if the temperature exceeds a first predetermined level; and stopping the directing of said portion of said refrigerant if the temperature is below a second predetermined level.

13. The system of claim 6, wherein the motor cooling device comprises:

at least two injectors located in the compressor for cooling at least two separate portions of the motor.

14. The system of claim 6, wherein the motor cooling device comprises:

a pipe surrounding the compressor, wherein the pipe is filled with said portion of the refrigerant.

15. The system of claim 6, wherein the motor cooling device comprises:

a cooling flow path filled with said portion of refrigerant, wherein said cooling flow path is located within a casing of said motor.

16. The system of claim 6, further comprising:

a temperature measuring unit for measuring the temperature of the motor;

a controller for controlling some of the refrigerant passed through the condenser to be flowed to a refrigerant dividing flow path when the temperature of the motor is higher than a set temperature; and an opening/closing means for opening/closing the refrigerant dividing flow path by controlling the controller.

17. The method of claim 12, wherein said directing of said portion of said refrigerant comprises:

separating said portion of said refrigerant when said refrigerant is flowing from a condenser to an expansion means in a cooling system;

directing said portion of said refrigerant to a compressor, wherein said compressor includes said motor; and cooling said motor using said portion of said refrigerant.

18. The method of claim 17, wherein said cooling of said motor using said portion of said refrigerant comprises:

injecting said portion of said refrigerant onto said motor on at least two separate surfaces of said motor.

19. The method of claim 17, wherein said cooling of said motor using said portion of said refrigerant comprises:

injecting said portion of said refrigerant into a pipe, wherein said pipe surrounds said motor.

20. The method of claim 17, wherein said cooling of said motor using said portion of said refrigerant comprises:

injecting said portion of said refrigerant into a cooling flow path, wherein said cooling flow path is located within a casing of said motor.

21. A cooling system, comprising:

a coil around a compressor motor, wherein the coil circulates refrigerant from a condenser to an expansion means.

22. The system of claim 21, wherein the coil is embedded in a casing of the compressor motor.

* * * * *